United States Patent [19]

Molins

[11] 4,093,075

[45] June 6, 1978

[54] EJECTION DEVICES

[75] Inventor: Desmond Walter Molins, London, England

[73] Assignee: Molins Limited, London, England

[21] Appl. No.: 780,131

[22] Filed: Mar. 22, 1977

[30] Foreign Application Priority Data

Mar. 27, 1976 United Kingdom ..... 12410/76

[51] Int. Cl.[2] ..... B07C 5/344

[52] U.S. Cl. ..... 209/73; 209/111.9

[58] Field of Search ..... 209/73, 74, 111.5, 111.6, 209/111.7, 111.9

[56] References Cited

U.S. PATENT DOCUMENTS

| | | | |
|---|---|---|---|
| 3,034,645 | 5/1962 | Groppe | 209/111.7 |
| 3,207,308 | 9/1965 | Kemp | 209/89 |
| 3,368,674 | 2/1968 | Koeppe | 209/79 |

*Primary Examiner*—Allen N. Knowles
*Attorney, Agent, or Firm*—John C. Smith, Jr.

[57] ABSTRACT

An ejection mechanism, primarily for use in association with the cigarette hopper of a cigarette packing machine having a vertical channel in which cigarettes may be stacked one above the other and descend intermittently, comprises a pair of support members at a support level higher than the bottom of said channel for supporting end portions of a cigarette in the channel and movable out of the channel to allow said cigarette to fall; sensing means at a level above the support level; an air nozzle at a level below the support level for producing an air-blast to displace a cigarette from the channel; and a valve controlled by the sensing means so that the air-blast operates when the cigarette at the nozzle level has a bad end detected by the sensing means. When the air-blast operates, the presence of support members relieves the cigarette to be displaced from carrying the weight of cigarettes stacked in the channel above the support members and hence permits the air-blast to produce a sufficient displacement.

6 Claims, 2 Drawing Figures

EJECTION DEVICES

Figure 1:
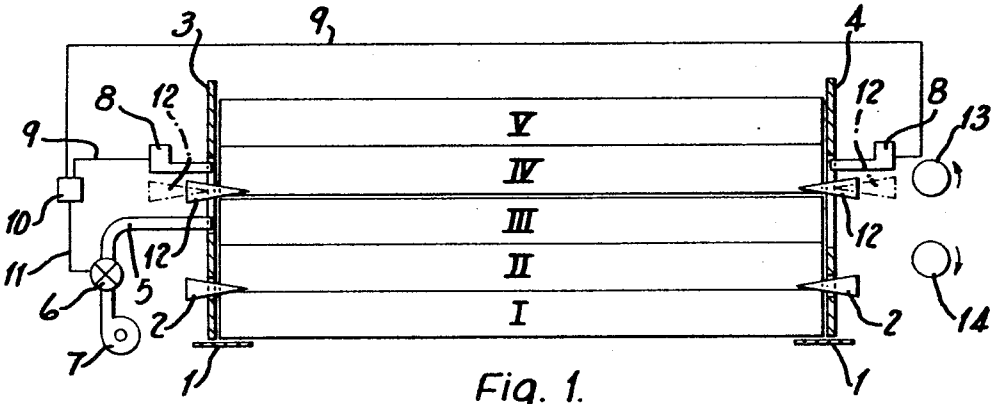

This invention relates to devices for ejection of selected (e.g. faulty) cigarettes from a stack; devices embodying the invention are also applicable to other like (i.e. rod-shaped) articles although for convenience only cigarettes will be mentioned in the following description.

In the production of cigarettes, faults in the product may arise at almost any stage in the manufacturing sequence. In the past, when speeds of operation were low, considerable reliance was placed on machine operators for detection and removal of faulty cigarettes; increased machine speeds have necessitated the introduction of automatic fault detectors and rejection mechanisms. A fault which may arise at virtually any stage of manufacture is a "bad end", which may be caused by tobacco dropping out of the end of the cigarette while it is being handled mechanically. A convenient position for detecting and rejecting cigarettes with bad ends is immediately prior to their being grouped in "bundles" for enclosure in a packet. It is an object of the present invention to provide an improved mechanism for ejection of faulty cigarettes at this stage of manufacture.

According to the invention, an ejection mechanism for cigarettes or like articles for association with means defining a vertical channel through which cigarettes may be stacked one above the other and descend intermittently comprises a pair of support members at a support level higher than the bottom of said channel, said support members being arranged so as to support end portions of a cigarette in said channel and being movable out of said channel to allow said cigarette to fall below said level, sensing means at a sensing level above said support level, an air nozzle disposed at a level below said support level to produce a horizontally-directed air-blast against one end of a cigarette to displace such cigarette from the channel, and a valve arranged to control air supply to said nozzle, said sensing means being connected to control said valve so that said valve is opened to allow said air-blast to operate when the cigarette at the level of the nozzle has a bad end detected by the sensing means.

It is preferred also to provide drive means horizontally aligned with said nozzle for engagement by any cigarette displaced from said channel by the air-blast and adapted to propel such displaced cigarette clear of said channel.

It will be clear that the opening of the valve necessarily occurs some time after the sensing means detects a bad end, so that the cigarette having the detected bad end has descended to the level of the nozzle when the air-blast occurs. Devices embodying the present invention are very conveniently used in association with a cigarette hopper having a feed mechanism for removing articles such as cigarettes from the hopper in which the cigarettes are accommodated in a plurality of vertical channels comprising lower and upper pairs of support members respectively disposed to support end portions of the lowest and next-to-lowest cigarettes in each channel, with drive means for separating the support members of each pair alternately to move clear of the channels, and means for producing a generally downward airstream past the lower support members while they are separated.

Figure 2:
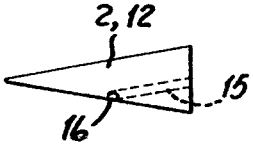

To enable the invention to be fully understood, a preferred embodiment thereof will now be described, with reference to the accompanying drawings in which:

FIG. 1 is a diagrammatic view of part of the hopper of a cigarette-packing machine fitted with a device embodying the invention and, FIG. 2 is a detail view of a part of the apparatus of FIG. 1.

Referring to the drawings, part of a cigarette hopper is shown containing cigarettes stacked one above the other in a vertical channel and marked, in order from bottom to top, with Roman numerals I to V. This stack has only one cigarette at each level but the hopper has other parallel channels containing similar stacks (not shown) separated from the stack shown in the drawing by walls (not shown) parallel to the plane of the drawing, each such stack being fitted with devices similar to those to be described.

The hopper has lower support members 1 and upper support members 2 at the bottom of the stack, the lower support members 1 engaging end portions of the lowest cigarette I and the upper support members 2 engaging end portions of the next-to-lowest cigarette II. In operation the members 1 are first separated to allow cigarette I to drop, and are then returned to the positions shown. Then members 2 are separated, and the whole stack of cigarettes drops until cigarette II is stopped by engagement with the members 1, members 2 then returning to the position shown. This cycle of operation is repeated at regular intervals, so that single cigarettes drop in regular succession from the bottom of the stack. In view of the presence of the parallel stacks (not shown) already mentioned, which have similar support members 1, 2 operating in synchronism with those shown, each cycle of operation of the support members results in a row of cigarettes dropping from the bottom of the hopper.

Walls 3, 4 suitably apertured to allow passage of the upper support members 2 maintain the ends of the cigarettes in alignment. At the level of cigarette III, an air nozzle 5 is provided, said nozzle facing one end of cigarette III through an aperture in the left-hand wall 3, and the nozzle 5 is connected via a valve 6 to a compressed-air source 7. At the level of cigarette IV, two similar sensing devices 8 respectively face the left- and right-hand ends of the cigarette IV; said sensing devices 8 are connected by control lines 9 to a delay unit 10 which in turn is connected by a control line 11 to the valve 6.

A pair of support members 12, movable horizontally in similar fashion to members 2, are provided at a level intermediate the cigarettes III and IV so that, when said members 12 are in the positions indicated in full lines, they engage the end portions of cigarette IV so as to support all the stack above cigarette III. The level of the support members 12 is slightly more than two cigarette diameters above the level of the support members 2, so that there is a small gap between cigarette III and cigarette IV.

Close outside the right-hand wall 4 are two drive rollers 13, 14; these rollers are mounted at levels equally spaced above and below the level of the centreline of cigarette III, the gap between the two rollers being equal to one cigarette diameter, and they are constantly rotated in anticlockwise and clockwise direction respectively, so that if cigarette III is displaced to the right to engage between rollers 13, 14 they drive it to the right.

In operation, as the stack of cigarettes descends due to the cyclic operation of support members 1, 2 whenever a cigarette with a bad end reaches the position of cigarette IV, whichever of the sensing units 8 is adjacent to the bad end emits a signal over respective line 9 to delay unit 10. After the next cycle of operation of members 1, 2 the cigarette with the bad end will have descended to the position of cigarette III and the signal previously received by unit 10 will be emitted via line 11 to valve 6. The valve 6 opens, an air-blast is emitted from nozzle 5, and the cigarette with the bad end is blown to the right, its right-hand end engages between rollers 13, 14, and the faulty cigarette is driven clear of the stack.

Before valve 6 opens, the members 12 move in to their full line positions, so the cigarette with the bad end, now at the position of cigarette III, does not carry the weight of any of the cigarettes above it in the stack and this enables the air-blast to move the faulty cigarette sufficiently to engage rollers 13, 14 to complete its ejection from the stack. The movement of the members 12 is synchronised with that of the members 2, as the members 12 must be in their separated position (shown in dashed line) while the members 2 are separated, and an economical arrangement is to link the members 12 to the members 2 by a rigid connection so that they always move together. It will however be seen that such an arrangement means that, if two consecutive cigarettes have bad ends, the second of these two consecutive cigarettes will not be ejected (after cigarette III is ejected, separation of the members 12 allows cigarette IV to fall to the level of cigarette II, below the level of nozzle 5).

Each of the members 2, 12 includes an internal air passage 15 (FIG. 2) leading to one or more downwardly-directed apertures 16. Air supplied through these passages and apertures whenever cigarettes below the support member 2, 12 are allowed to descend accelerates such descent and hence allows the overall speed of the whole apparatus to be higher.

In most instances it will be so unlikely that two consecutive cigarettes have bad ends that failure to eject the second consecutive faulty cigarette is not significant. However, if this cannot be tolerated, then the ejection device may be mounted higher relative to the stack and a further pair of support members (not shown) similar to the members 2, 12 may be provided to support the cigarette at the ejection level i.e. the level of nozzle 5. In this arrangement, the movement of members 12 and of the further members (not shown) would need to be related to the operation of the air-blast. Both these pairs of support members would remain separated until one of the sensing devices 8 signalled a bad end then, after the next cycle of operation of the members 1, 2, the members 12 would be brought into the stack to support the cigarettes above the one to be ejected; the valve 6 would be opened to provide the air-blast, the further support members brought in, and members 12 separated to allow the upper part of the stack to descend. The members 12 and the further support members would need to continue operating (in similar manner to members 1, 2) until there was no gap below the further support members, after which both these pairs of members could be withdrawn from the stack until the next bad end was detected. The cycle of operation of the members 12 and the further support members would need to be of slightly shorter duration than that of the members 1, 2 so that the feed of cigarettes to the lower part of the stack (i.e. the part below the further support members) could make up for the occasional gaps due to ejection of faulty cigarettes.

The sensing devices 8 may be of various forms, e.g. they may be acoustic devices as disclosed in U.S. Pat. No. 3,720,311. While as described above the ejection of a cigarette from the stack is controlled solely by the sensing of bad ends by the devices 8, if desired the valve 6 may be arranged to be operable also under the control of further sensing devices (not shown) at a higher level in the stack, such further sensing devices serving to detect the presence of faults other than bad ends.

I claim:

1. An ejection mechanism for cigarettes or like articles for association with means defining a vertical channel through which cigarettes may be stacked one above the other and descend intermittently, comprising a pair of support members at a support level higher than the bottom of said channel, said support members being arranged so as to support end portions of a cigarette in said channel and being movable out of said channel to allow said cigarette to fall below said support level, sensing means at a sensing level above said support level, an air nozzle disposed at a level below said support level to produce a horizontally-directed air-blast against one end of a cigarette to displace such cigarette from the channel, and a valve arranged to control air supply to said nozzle, said sensing means being connected to control said valve so that said valve is opened to allow said air-blast to operate when the cigarette at the level of the nozzle has a bad end detected by the sensing means.

2. Mechanism as claimed in claim 1, including drive means horizontally aligned with said nozzle for engagement by any cigarette displaced from said channel by the air-blast and adapted to propel such displaced cigarette clear of said channel.

3. Mechanism as claimed in claim 2, in which said drive means comprises a pair of constantly-rotated rollers, mounted close outside the channel at levels equally spaced above and below the level of the centre-line of a cigarette in the path of the air-blast so that the gap between said rollers is equal to one cigarette diameter.

4. Mechanism as claimed in claim 3 in which the sensing means comprises two sensing units disposed respectively to face one end and the other end of a cigarette at the sensing level.

5. Mechanism as claimed in claim 4, in which said two sensing units are connected to a delay unit which in turn is connected to the valve.

6. Mechanism as claimed in claim 5 in which each of said support members includes an internal air passage leading to at least one downwardly-directed aperture so that whenever cigarettes below the support level are allowed to descend air may be supplied through said passage and aperture to accelerate such descent.

* * * * *